United States Patent [19]

Beckley

[11] 4,079,995

[45] Mar. 21, 1978

[54] FURNITURE STRUCTURE AND JOINT FOR USE THEREWITH

[76] Inventor: Charles R. Beckley, 2708 Woodley Pl., N.W., Washington, D.C. 20008

[21] Appl. No.: 775,604

[22] Filed: Mar. 8, 1977

[51] Int. Cl.[2] ..... A47C 7/00

[52] U.S. Cl. ..... 297/440; 403/171; 403/217

[58] Field of Search ..... 297/440, 442, 445, 446; 403/171, 172, 176, 231, 346, 219

[56] References Cited

U.S. PATENT DOCUMENTS

| | | | |
|---|---|---|---|
| 693,197 | 2/1902 | White | 297/440 X |
| 1,392,242 | 9/1921 | Albergoli | 297/445 |
| 1,645,336 | 10/1927 | McGlothern | 108/159 |
| 1,747,900 | 2/1930 | Jenny | 297/442 |
| 1,753,487 | 4/1930 | Vaaler | 403/171 |
| 1,763,748 | 6/1938 | Best | 403/219 |
| 1,813,072 | 7/1931 | Murdock | 144/318 |
| 2,932,477 | 4/1960 | Franks | 403/219 X |
| 3,396,933 | 8/1968 | Ward | 403/219 X |
| 3,455,605 | 7/1969 | Anderson | 297/445 |
| 3,490,809 | 1/1970 | Lange | 297/440 |
| 3,887,288 | 6/1975 | Glaser | 403/219 |
| 3,950,028 | 4/1976 | Schnepel | 297/442 X |
| 3,973,854 | 8/1976 | Gilbo et al. | 403/171 |

FOREIGN PATENT DOCUMENTS

| | | | |
|---|---|---|---|
| 1,403,005 | 5/1965 | France | 297/440 |
| 1,261,728 | 4/1961 | France | 297/446 |

*Primary Examiner*—James C. Mitchell
*Attorney, Agent, or Firm*—Bacon & Thomas

[57] ABSTRACT

A furniture structure utilizes a joint which allows three elongated members to be coupled orthogonally. In a preferred embodiment of the invention, the joint is utilized in a chair in which a first elongated member is a side rail, a second elongated member is a brace, and a third elongated member is one leg of the chair. The first member, which forms the side rail, has oppositely facing notches in each end thereof. A projecting tongue is formed between the oppositely-facing notches. The second member, which forms a brace, has a threaded insert therein and is received in one of the oppositely-facing notches in the first member. The third member, which forms a leg, has a notch therein and is received in the other oppositely-facing notch of the first member, while the tongue of the first member is received in the notch of the third member. A machine screw is passed through the third and first members and is screwed into the threaded insert of the second member to hold all three members together.

12 Claims, 5 Drawing Figures

FURNITURE STRUCTURE AND JOINT FOR USE THEREWITH

BACKGROUND OF THE INVENTION

1. Field of the Invention

The instant invention relates to mechanical joints, and more particularly, the instant invention relates to joints for use with furniture, specifically for use with chairs.

2. Technical Considerations and Prior Art

Generally, in the manufacture of furniture, specifically in the manufacture of furniture such as chairs and tables, it is necessary to utilize a joint in which three mutually orthogonal members project from one point to form a corner. For example, in chairs, these joints occur at the points where the side rails, braces and legs intersect and are attached. These joints are subject to considerable stress, since the abutting areas which form the joints are relatively small. Consequently, the useful life of a chair or other piece of furniture is frequently terminated early because of joint failure.

In order to provide relatively strong joints, it has been necessary in the past to utilize extra bracing at the corners of chairs and to utilize relatively expensive woods which can withstand the varied and frequent stresses applied to the joints of chairs. In addition, these joints usually necessitated the use of glues and multiple fasteners for assembly, and the assembly, consequently, had to be performed in a factory. The furniture was then stored and shipped completely assembled, which resulted in increased storage and shipping costs, as well as the labor costs of assembling the chairs at the factory.

In recent years, there has been much emphasis placed on knockdown furniture in which the various components of a furniture piece are cut in a factory and then shipped to retail outlets in knockdown form. The furniture is then assembled by the purchaser. With many of these knockdown furniture kits, the furniture still consumes a great deal of space in knockdown form and is relatively difficult to assemble. Consequently, there is a need for simple, inexpensive and compact knockdown furniture.

OBJECTS OF THE INVENTION

In view of the foregoing considerations, it is an object of the instant invention to provide a new and improved joint for chairs and other types of furniture.

It is a further object of the instant invention to provide a new and improved joint for chairs and other types of furniture which will reduce the overall cost of the chairs or furniture.

It is still a further object of the instant invention to provide a new and improved joint for chairs and other types of furniture which is strong and long-lasting, yet is simple and easy to assemble.

It is a further object of the instant invention to provide a new and improved joint for chairs and other types of furniture wherein the chairs or furniture can be easily assembled by the average purchaser with minimal tools.

It is still a further object of the instant invention to provide a new and improved joint for chairs and other types of furniture which allow the chairs or furniture to be mass produced without the use of highly skilled labor.

It is another object of the instant invention to provide a new and improved joint for chairs and other types of furniture wherein the joints allow the chairs or furniture to be stored and shipped compactly.

SUMMARY OF THE INVENTION

With these and other objects in mind, the instant invention contemplates a furniture structure comprising a pair of rails with first and second ends. Each end of the rails has an inner and outer notch. First and second braces are provided to extend between the rails and seat within the inner notches at the first and second ends of the rails to form a rectangular frame. First and second pairs of legs, having notches in the tops thereof, register with the outer notches of the rails while the rails register within the notches at the tops of the legs. The joints formed by the intersection of the rails, braces and legs are held together with fastening means that extend through the legs and rails, and into the braces.

BRIEF DESCRIPTION OF THE DRAWINGS

Referring now to FIGS. 1 and 2, there is shown a chair, designated generally by the numeral 10, which is composed of a frame, designated generally by the numeral 11, and a seat, designated generally by the numeral 12, and shown partially cut away. The frame 11 includes front joints 13 and rear joints 14. The novelty of the instant invention resides in the structure of the joints 13 and 14 when incorporated with the structure of the chair 10. While a chair 10 is shown in order to illustrate the inventive features of the joints 13 and 14, it should be kept in mind that the joints could also be used with a sofa, loveseat, table, or other pieces of furniture.

Figure 2:
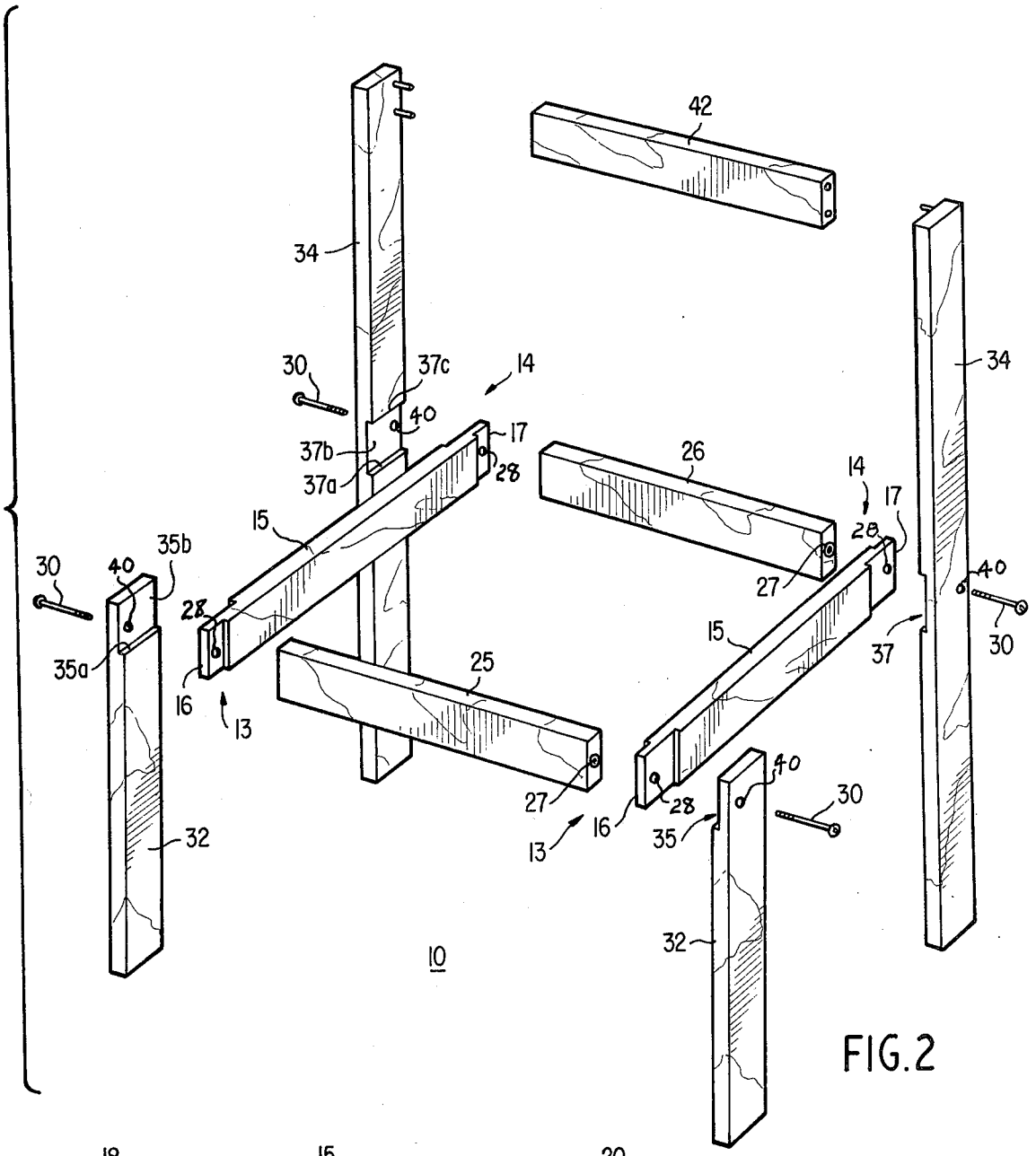
FIG. 2 is an exploded view of the chair shown in FIG. 1.

As is seen in FIG. 2, the joints 13 and 14 can be readily disassembled by removing screws 30, one of which is inserted through each joint. The various components of the frame 11 can then be arranged so as to all extend in the same direction so as to form a relatively compact elongated package for storage and shipment. The seat 12 can be stored and shipped separately. For example, the various components of the frame 11 for each chair can be separately packaged at the factory while a number of seats 12 can be placed in the same package or box. When the chairs 10 arrive at the retail outlet, they are then sold by selling a frame package along with one of the seats from the separate seat package.

Figure 4:
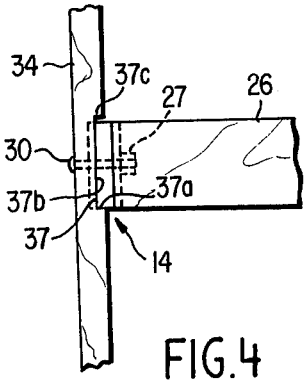
FIG. 4 is a back view partially cut away of the chair shown in FIG. 1.
Figure 3:
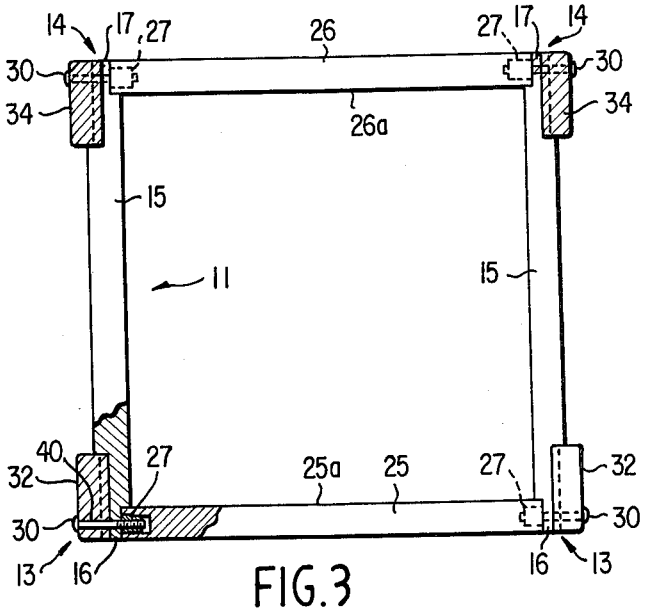
FIG. 3 is a top view partially in section of the chair shown in FIG. 1.
Figure 5:
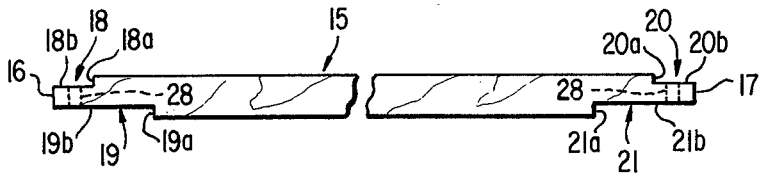
FIG. 5 is a top view of a side brace utilized in the chair of FIG. 1.

Referring now to FIGS. 3, 4 and 5, the structure of the joints 13 and 14 is shown to depend on the interaction between various shoulders which result from notching the components of the frame 11. As seen in FIGS. 3 and 5, the frame 11 includes side rails 15 which have the first ends 16 and second ends 17. The first end has an inner notch 18 and an outer notch 19, while the second end has an inner notch 20 and outer notch 21. The notches 18, 19, 20 and 21 are preferably right angle notches which provide abutting surfaces **18*b*, 19*b*, 20*b* and 21*b*, and also provide shoulders 18*a*, 19*a*, 20*a* and 21*a*. As seen in FIG. 3, front and rear braces 25 and 26** are seated between the inner notches 18 and 20 of the side rails 15. The braces 25 and 26 have flat ends which abut the surfaces 18*b* and 20*b* of the notches while the perpendicular shoulders 18*a* abut the inner surfaces 25*a* and 26*a* of the braces in order to prevent the braces from twisting. Each brace has a screw insert 27 recessed within both ends. This recess registers with smooth holes 28 in tongue portions of the first and second ends of braces 15, which tongue portions are created between the notches 18 and 19, and 20 and 21. As will be explained later, screws 30 project through the holes 28 and are threaded into the inserts 27 to hold the braces 25 and 26 to the side rails 15.

Figure 1:
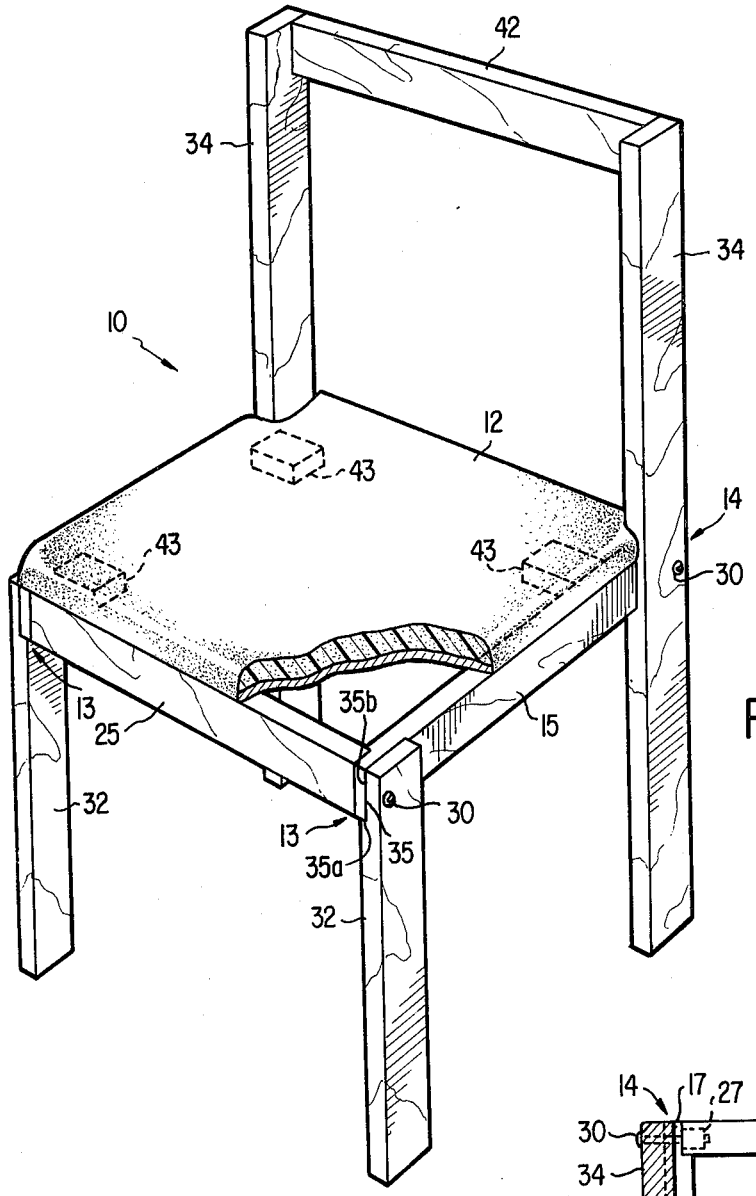
FIG. 1 is a perspective view of a chair according to the instant invention showing the chair assembled with a seat panel.

The rectangular structure created by the assembly of braces 25 and 26 and side rails 15 is held in spaced relation to the floor or surface upon which the chair 10 sits by front legs 32 and rear legs 34. The front legs 32 each have a notch 35 at the top end thereof which includes a flat surface 35*b* and a shoulder 35*a*. The rear leg 34 has a slot 37 formed therein which includes a flat surface 37*b* and upper and lower shoulders 37*a* and 37*c*. As seen in FIGS. 1, 3 and 4, the front legs 32 are received within the outer notches 19 at the front end 16 of the braces 15, while the rear legs 34 are received within the outer rear notches 21 at the rear end 17 of the braces 15. The front and rear legs are then held in place by the bolts 30 which pass through holes 40 in the legs, holes 28 in the rails 15, and are threadably received by inserts 27 in the front and rear braces 25 and 26. The bottom surfaces of the side rails 15 rest on the shoulders 35*a* of the front legs 32 and 37*a* of the rear legs 34, while the shoulders 19*a* and 21*a* engage the inner surfaces of the legs 32 and 34, respectively. When the bolts 30 are tightened, a rigid joint is created, because none of the components of the frame 11 can twist relative to another component due to abutment between the various shoulders and the surfaces of the various components.

In order to form a back of the chair, the rear leg 34 extends above the rectangular frame formed by the braces 25 and 26 and side rails 15, and a upper back brace 42 is retained by pins or the like between the upper portions of the rear legs 34.

As seen in FIGS. 1 and 2, the seat 12 rests on the planar surface defined by the side rails 15 and front and rear braces 25 and 26. Projections 43 extend downwardly from the seat 12, adjacent each corner of the seat 12, and fit in the corners where the side rails 15 and front and rear braces 25 and 26 join one another. In this way, the seat is located properly with respect to the frame 11 and will not slip off.

The foregoing structure provides a very strong simple chair which may be easily disassembled for shipping and storage and may be quickly and easily assembled by a purchaser.

The foregoing embodiment is merely illustrative of the instant invention and the invention is limited only by the following appended claims.

I claim:

1. A furniture structure comprising:

a pair of rails with first and second ends, wherein each end has inner and outer notches;

first and second braces extending between the rails and seating in the inner notches at the first and second ends of the rails to form a rectangular frame;

first and second pairs of legs having notches therein, said legs supporting the rectangular frame in spaced relation to ground, said first legs being received in the outer notches at the first end of the rails and said rails being received in the notches of said first legs said second legs being received in the outer notches at the second end of the rails and said rails being received in the notches of said second legs; and fastening means extending through said each of said legs, each end of said rails and into each end of said braces to secure them together.

2. The furniture structure of claim 1 wherein the fastening means are screws.

3. The furniture structure of claim 2 wherein the screws slide through holes in the legs and rails and are threaded into inserts in the braces.

4. The furniture structure of claim 1 wherein the notches are rectangular.

5. The furniture structure of claim 3 wherein the notches are rectangular.

6. The furniture structure of claim 1 wherein the rectangular frame forms a support for a seat which rests thereupon.

7. The furniture structure of claim 6 wherein the second legs have the notches intermediate the ends thereof and a portion extending above the notches wherein the extending portion forms a support for the back of the chair.

8. The furniture structure of claim 7 wherein a cross piece is provided between the extending portions to form a back.

9. The furniture structure of claim 8 wherein the fastening means are screws which pass through holes in the legs and rails and are retained in threaded inserts within the braces.

10. The furniture structure of claim 9 wherein the notches are rectangular.

11. A joint for connecting three mutually perpendicular members comprising:

a first elongated member having an end portion with a pair of opposed rectangular notches which define a tongue therebetween;

a second elongated member having a rectangular end portion with a threaded insert therein, wherein the end portion of the second member is received in one notch in the end of the first member;

a third elongated member having a single notch in the end thereof, the end of said third member being received in the other notch of the first member while receiving the tongue of the first member in said single notch; and a screw which passes through the third member and first member and is threaded into the second member to hold the members together.

12. The joint of claim 11 wherein the joint is used for a chair wherein:

a first member is a side rail of the chair, the second member is a cross brace of the chair, and the third member is one leg of the chair.

* * * * *